United States Patent [19]

Thomas

[11] Patent Number: 4,762,303

[45] Date of Patent: Aug. 9, 1988

[54] LUMBER TURNING TOOL

[76] Inventor: Philip G. Thomas, 1257 Siskiyo Blvd., Ashland, Oreg. 97520

[21] Appl. No.: 2,748

[22] Filed: Jan. 12, 1987

[51] Int. Cl.[4] ..... B25C 11/00

[52] U.S. Cl. ..... 254/25; 254/131

[58] Field of Search ..... 254/18, 21, 25, 120, 254/131, 131.5

[56] References Cited

U.S. PATENT DOCUMENTS

| | | | |
|---|---|---|---|
| 1,167,574 | 1/1916 | Lechner | 254/25 |
| 2,015,194 | 9/1935 | Rüping | 254/25 |
| 4,625,945 | 12/1986 | Hearn et al. | 254/25 |

*Primary Examiner*—Frederick R. Schmidt
*Assistant Examiner*—Judy J. Hartman
*Attorney, Agent, or Firm*—William W. Haefliger

[57] ABSTRACT

In a lever type tool, the combination comprising:

(a) an elongated handle, and (b) a head having two opposed and spaced apart claws projecting in generally the same direction at opposite sides of a space to closely receive a portion of a rectangular cross section of a lumber member, (c) one of the claws at one side of said space being substantially shorter in length than the other of the claws at the opposite side of said space.

5 Claims, 2 Drawing Sheets

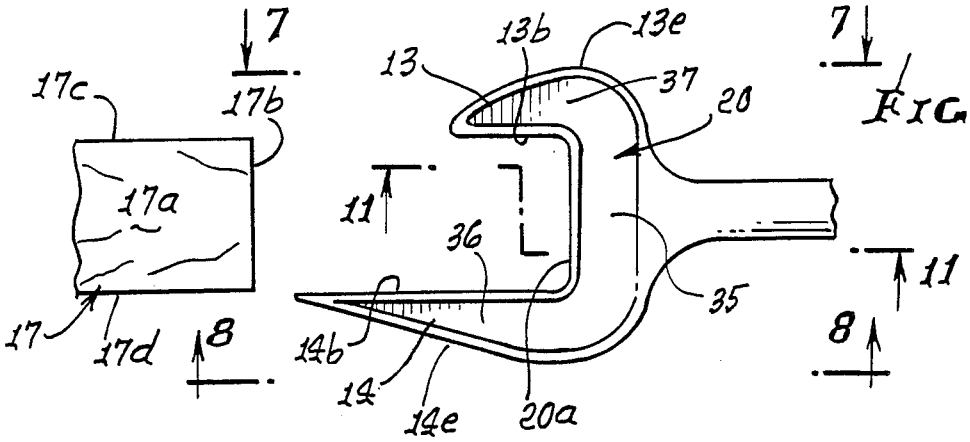
FIG. 6.
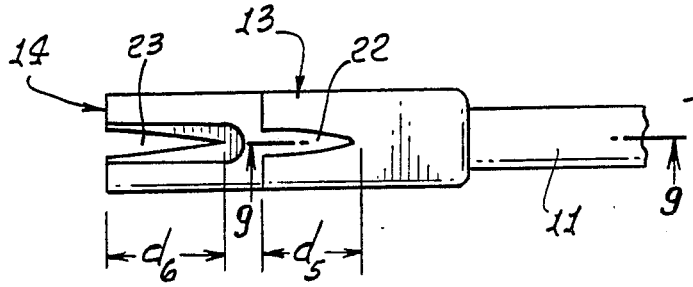
FIG. 7.
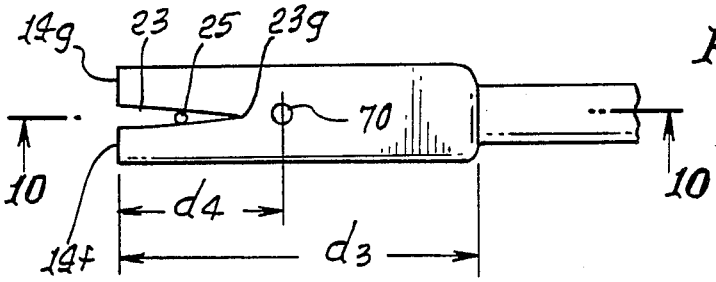
FIG. 8.
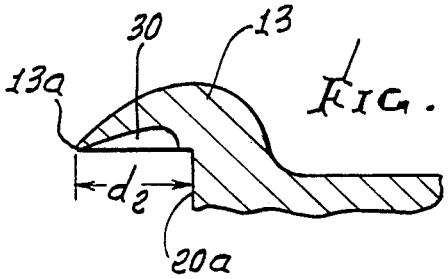
FIG. 9.
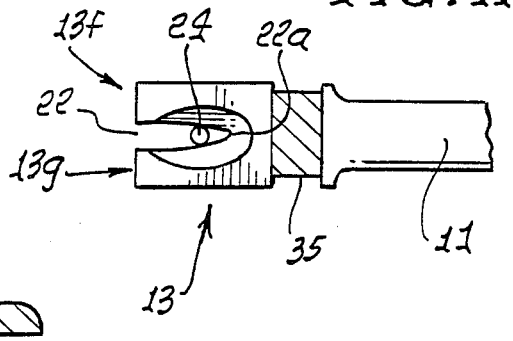
FIG. 11.
FIG. 10.
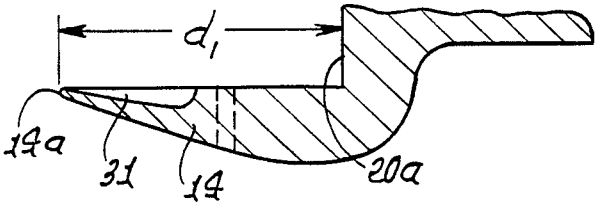

LUMBER TURNING TOOL

BACKGROUND OF THE INVENTION

This invention relates generally to tools of the type used for prying or loosening; and more particularly concerns a tool constructed especially to fit heavy duty lumber pieces, for prying them or forcibly twisting them, into desired positions, as for release from attachment to other members or for positioning them for nailing.

There is a need for tools of the character described above, since ordinary hammers lack the lumber prying or gripping capabilities required For example, exertion of torque or twisting force on a wooden board of 2 inches by 4 or more inches cross section is frequently required during framing. Prior tools lacked the capability to easily handle such twisting and lacked other features of the tool described herein

SUMMARY OF THE INVENTION

It is a major object of the invention to provide solutions to the above problems and difficulties, and also to provide a unique tool having multiple capabilities, for handling heavy duty wooden lumber members. Basically, the tool comprises:

(a) an elongated handle, and (b) a head having two opposed and spaced apart claws projecting in generally the same direction at opposite sides of a space to closely receive a portion of a rectangular cross section of a lumber member, (c) one of the claws at one side of said space being substantially shorter in length than the other of the claws at the opposite side of said space.

As will appear, the head is typically C-shaped; and the head may have a transverse section interconnecting the claws, said claws having parallel faces at opposite sides of said space, said transverse section having a transverse face at the innermost side of said space, said transverse face extending in a plane that is normal to planes defined by said parallel faces. The claws have outer surfaces, and the inner and outer surfaces of each claw taper toward a tip; and the tips are located at substantially different distances from the transverse inner face of the head.

Further, each claw is typically bifurcated to define tines having edges for nail gripping; and the tine edges of one claw are typically straight, whereas the tine edges of the other claw are typically concave, whereby nails of a wide range of cross-section sizes may be gripped and pulled. Further, the tines taper toward tips, facilitating penetration of the claws beneath members to be pried loose from connection to other members These and other objects and advantages of the invention, as well as the details of an illustrative embodiment, will be more fully understood from the following specification and drawings, in which:

DRAWING DESCRIPTION

FIG. 6 is a fragmentary side view of the head of the FIG. 1 tool;

FIG. 7 is a top plan view taken on lines 7—7 of FIG. 6;

FIG. 8 is a bottom plan view taken on lines 8—8 of FIG. 6;

FIG. 9 is a section taken on lines 9—9 of FIG. 7;

FIG. 10 is a section taken on lines 10—10 of FIG. 9; and

FIG. 11 is a section taken on lines 11—11 of FIG. 6.

DETAILED DESCRIPTION

Figure 1:
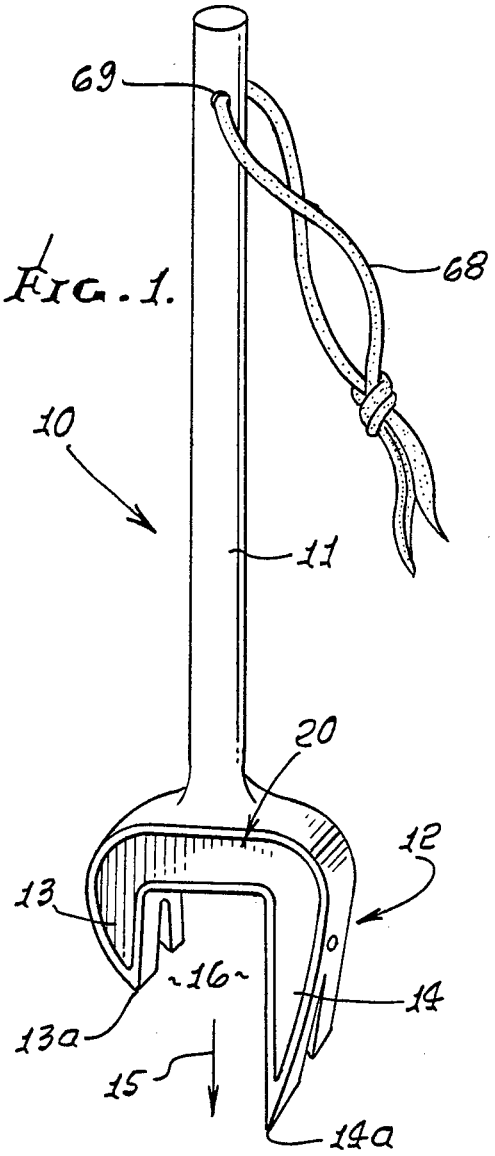
FIG. 1 is an elevation in perspective showing a tool embodying the invention.

In FIGS. 1 and 6–11, the lever type tool 10 comprises an elongated handle 11, and a head 12 integral with the handle at one end thereof Both the head and handle may consist of steel, the head being hardened. It has two spaced apart claws 13 and 14 projecting in generally the same direction, see arrow 15, and at opposite sides of a space 16, to closely receive a portion 17*a* of a rectangular cross section 17 of a lumber member, as for example a wooden two inch by four inch section as is commonly used in construction framing. One of the claws, i.e. claw 13, as shown, is substantially shorter in length than the other, claw 14 as shown, for several reasons as will appear. One reason is to facilitate grasping of the member 17, as shown in FIG. 2, with full reception of the lumber portion 17*a* into space 16.

Head 12 is C-shaped, and the claws taper toward their tips at 13*a* and 14*a*. This facilitates loosening, as by prying, of a member 17 nailed at 18 to another member or wall 19. Elongated claw 14 progressively penetrates behind the member 17, i.e. between member 17 and wall 19 during such prying, and during progressive grasping of the portion 17*a* by the claws.

Figure 2:
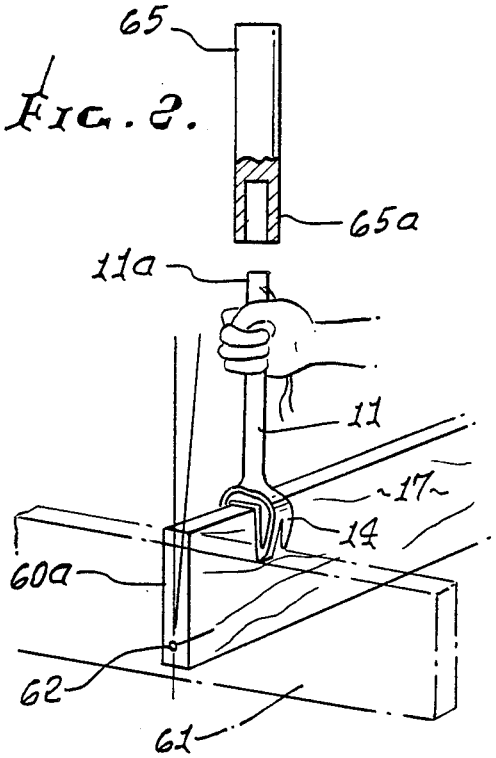
FIGS. 2–5 are perspective showing various uses of the FIG. 1 tool.
Figure 3:
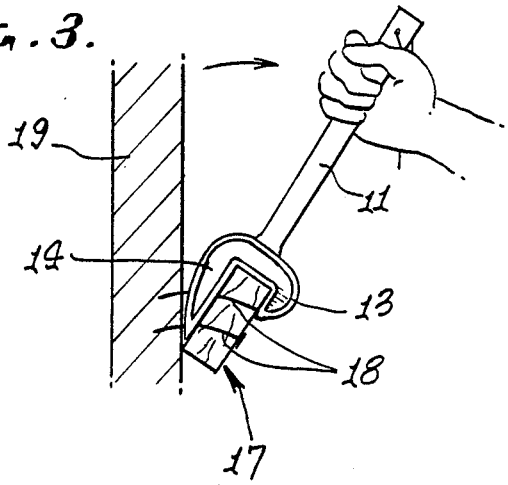

The head also includes an transverse section 20 interconnecting the claws, section 20 having a transverse face 20*a* at the innermost side of space 16. Face 20*a* extends in a plane that is normal to planes defined by parallel faces 13*b* and 14*b* of the claws, at opposite sides of space 16. Face 20*a* squarely and closely faces (and may engage) the end 17*b* of a wooden member 17 when faces 13*b* and 14*b* engage opposite sides 17*a* and 17*d* of that member, as is clear from FIGS. 2 and 6. For best results, the length $d_1$ between face 20*a* and tip 14*a* is approximately 2.5 times the length $d_2$ between face 20*a* and tip 13*a*. Typically, $d_1$ is about 7.5 centimeters, and $d_2$ is about 3 centimeters in length. Note that the outer surfaces 13*e* and 14*e* of the claws are outwardly convex, along these lengths between the transverse member 20 (with which such outer surfaces merge) and the tips 13*a* and 14*a*, for maximum claw strength, and also to permit rocking against the surface of a member as at 19 in FIG. 3.

Figure 5:
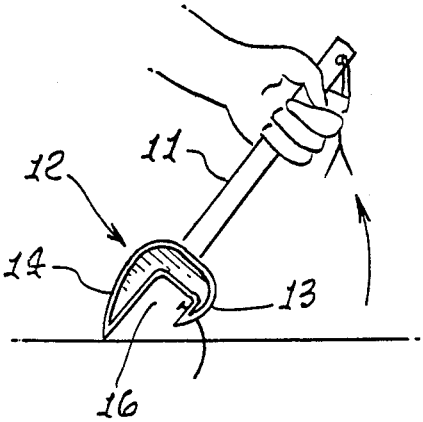
Figure 4:
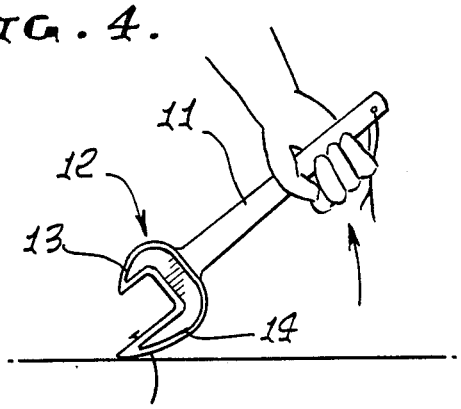

For nail pulling purposes, each rod claw is typically bifurcated, so as to form tines 13*f* and 13*e* associated with claw 13, and tines 14*f* and 14*e* associated with claw 14. The split 22 between tines 13*f* and 13*e* tapers toward an inner terminus 22*a*; and the split 23 between tines 14*f* and 14*e* tapers toward an inner terminus 23*a*. See FIGS. 7–11 in these regards. Note that the jaw edges 22*b* and 22*c* defined by split 22 may be cocavely curved (as viewed in FIGS. 7 and 11) toward terminus 22*a*, whereby a nail 24 of relatively larger cross section may be grasped by such edges for ease of nail pulling (see FIG. 5); whereas the jaw edges 23*b* and 23*c* defined by split 23 (see FIG. 8) are linear, whereby a nail 25 of relatively lesser cross section may be grasped by such edges for ease of nail pulling (see FIG. 4). Note the large amount of lenerage permitted, as in FIG. 5.

Also, the inner sides of the tines of each claw are recessed, to define bowl shaped depressions as at 30 and 31. Such recesses are adapted to receive nail heads during nail pulling, whereby the extent of tine penetration required under or behind a nail head is minimized.

Finally, the opposite sides of the head 12 may be recessed as at 35–37, to reduce head weight.

FIG. 2 illustrates an important use of the tool 10. It is shown gripping an elongated wooden member 17 of rectangular cross section, for twisting its end 60*a* into position for nailing connection to a transverse wooden member 61. One nail 62 extending through member 61 and into end 60*a* acts as a pivot, and the tool forcibly rotates the end 60 into position to receive a second nail through member 61 and into end 60*a* securing it in position. The opposite remote end of member 17 is rigidly secured to other structure. Increased torque can be applied by connection of a bar 65 to the handle, as seen in FIG. 2. Bar 65 has a tubular end 65*a* adapted to closely fit over the end 11*a* of the tool handle, as shown. Note opening 70, for a tool hanging peg.

FIG. 1 also shows a thong 68 attached at 69 to the handle, for ease of supporting the tool when not in use. For best results, tool dimensions are as follows:

$d_1$=7.5 cm.
$d_2$=3 cm.
$d_3$=9.4 cm.
$d_4$=4.3 cm.
$d_5$=2.5 cm.
$d_6$=3 cm.

I claim:

1. In a lever type tool, the combination comprising:

(a) an elongated handle, and (b) a one-piece integral generally C-shaped head having two opposed and spaced apart claws projecting in generally the same direction at opposite sides of a space to closely receive a portion of a rectangular cross section of a lumber member, (c) one of the claws at one side of said space being substantially shorter in length than the other of the claws at the opposite side of said space, (d) said integral head including a transverse section interconnecting the claws, said claws having inner surfaces defining faces that are parallel throughout their lengths at opposite sides of said space, said space having an innermost side, said transverse section having a transverse face at said innermost side of said space, said transverse face always extending in a plane that is normal to planes defined by said parallel faces, (e) each of said claws being bifurcated to define tines, (f) said one bifurcated claw defining a recess, intersecting said face of the one claw, (g) said claws also having outer surfaces, and wherein said inner and outer surfaces of each claw taper toward a tip, (h) said tips being at distances $d_1$ and $d_2$ from said transverse face, $d_1$ being approximately 2.5 $d_2$.

2. The combination of claim 1 including said portion of said section of the lumber member received in said space, said portion defining two parallel opposite faces extending adjacent said opposed faces of the respective claws, the short claw having length less than half the width of said member, and the other claw having length greater than half the width of the lumber member.

3. The combination of claim 1 wherein the tines of one claw defines concave edges, and the tines of the other claw defined linear edges.

4. The combination of claim 1 wherein $d_1$ is about 7.5 centimeters and $d_2$ is about 3 centimeters.

5. The combination of claim 1 wherein said claw outer surfaces are outwardly convex along their lengths between said transverse member and said tips.

* * * * *